US006935729B2

(12) United States Patent
De Marco et al.

(10) Patent No.: US 6,935,729 B2
(45) Date of Patent: Aug. 30, 2005

(54) INK REPLENISHMENT SYSTEM AND METHOD FOR A CONTINUOUS FLOW INK JET PRINTER

(75) Inventors: Angelo J. De Marco, Brighton, MI (US); Thomas W. Howard, Harrisburg, NC (US); Dennis D. Leak, Kannapolis, NC (US); Clair F. Robe, Huntersville, NC (US)

(73) Assignee: International Business Machines Corporation, Armonk, NY (US)

( * ) Notice: Subject to any disclaimer, the term of this patent is extended or adjusted under 35 U.S.C. 154(b) by 68 days.

(21) Appl. No.: 10/650,214

(22) Filed: Aug. 28, 2003

(65) Prior Publication Data

US 2005/0057627 A1 Mar. 17, 2005

(51) Int. Cl.[7] ..... B41J 2/02; B41J 2/18

(52) U.S. Cl. ..... 347/73; 347/89; 347/93; 347/6

(58) Field of Search ..... 347/73, 74, 81, 347/84, 85, 89, 90, 93, 6, 7

(56) References Cited

U.S. PATENT DOCUMENTS 4,314,263 A 2/1982 Carley
4,636,814 A * 1/1987 Terasawa ..... 347/86
5,473,350 A * 12/1995 Mader et al. ..... 347/7
5,481,288 A 1/1996 Keeling et al.
6,869,160 B2 * 3/2005 West et al. ..... 347/28

FOREIGN PATENT DOCUMENTS

| | | | |
|---|---|---|---|
| JP | 55086760 | A | 6/1980 |
| JP | 60174654 | A | 9/1985 |
| JP | 63209845 | A | 8/1988 |
| JP | 63268655 | A | 11/1988 |
| JP | 2000218808 | A | 6/2000 |
| JP | 2002067347 | A | 3/2002 |
| JP | 2003011349 | A | 1/2003 |

* cited by examiner

*Primary Examiner*—Lamson Nguyen
(74) *Attorney, Agent, or Firm*—Douglas A. Lashmit; Hoffman, Warnick & D'Alessandro LLC

(57) ABSTRACT

A system and method for supplying replenishment fluid to an ink tank, wherein the ink tank includes a supply line to supply ink to a nozzle and a return line to receive unused ink. The method comprises the steps of periodically using a control system to recalibrate the ink pressure along the supply line to obtain an optimal print quality; and after the ink pressure has been recalibrated, using the control system to automatically adjust a supply rate of the replenishment fluid to the ink tank, wherein the supply rate of the replenishment fluid is adjusted based on the recalibrated ink pressure.

20 Claims, 2 Drawing Sheets

INK REPLENISHMENT SYSTEM AND METHOD FOR A CONTINUOUS FLOW INK JET PRINTER

BACKGROUND OF THE INVENTION

1. Technical Field

The present invention relates generally to ink replenishment systems, and more specifically to an ink replenishment system and method for a continuous flow ink jet printer using pressure feedback.

2. Background Art

Since its mass-market introduction in the mid-1970's, ink jet printing continues to be one of the most popular printing technologies. Ink jet is a non-impact dot-matrix printing technology in which droplets of ink are jetted from a small aperture directly to a specified position on a media to create an image. Continuous flow ink jet printing involves a process in which a stream of ink is broken into droplets of uniform size and spacing and passed through an electrical charge. The charged drops are deflected into a gutter for recirculation, and the uncharged drops fly directly onto the media to form an image.

One of the difficulties of continuous flow ink jet ink printing involves ink quality degradation caused during the recirculation process. In particular, as the ink flows from the print nozzles, water from the ink evaporates. Accordingly, the ink that is recirculated back to the ink tank tends to be more viscous. To compensate, a replenishment tank holding replenishment fluid is connected with a valve to the ink tank to help maintain a constant ink viscosity.

In current embodiments, the amount of replenishment fluid that flows to the ink tank is controlled using some type of manual adjustment. In one typical embodiment, the valve connecting the replenishment tank to the ink tank allows a fixed amount of replenishment fluid to enter the ink tank during periodic activations of the valve. Unfortunately, fluctuations in external conditions, such as humidity, can significantly impact the amount of required replenishment fluid. Accordingly, incorrect viscosity can occur over relatively short durations and result in print failure.

Thus, a need exists for an ink replenishment system that can ensure a correct amount of replenishment fluid is being added to the ink tank in a continuous flow ink jet printer.

SUMMARY OF THE INVENTION

The present invention addresses the above-mentioned problems, as well as others, by providing an ink replenishment system and method for a continuous flow ink jet printer that uses pressure feedback data to regulate the amount of replenishment fluid to be added to the ink tank.

In a first aspect, the invention provides a continuous flow ink jet printer, comprising: a nozzle that receives ink from a supply line and generates ink drops; an ink tank for providing ink to the supply line; an ink gutter for recirculating unused ink drops back to the ink tank; a replenishment tank that provides replenishment fluid for the ink tank; and a control system that controls the flow of replenishment fluid to the ink tank based on an ink pressure along the flow line.

In a second aspect, the invention provides a replenishment system for supplying replenishment fluid to a supply tank, wherein the supply tank includes a supply line to supply a source fluid to a work piece and a return line to receive unused source fluid, the system comprising: a replenishment tank that provides replenishment fluid for the supply tank, wherein the replenishment fluid adjusts a viscosity of the source fluid; a valve that activates a flow of replenishment fluid into the supply tank; and a control system that controls the activation of the valve based on a pressure in the supply line proximate the work piece.

In a third aspect, the invention provides a method for supplying replenishment fluid to an ink tank, wherein the ink tank includes a supply line to supply ink to a nozzle and a return line to receive unused ink, the method comprising: periodically using a control system to recalibrate the ink pressure along the supply line to obtain an optimal print quality; and after the ink pressure has been recalibrated, using the control system to automatically adjust a supply rate of the replenishment fluid to the ink tank, wherein the supply rate of the replenishment fluid is adjusted based on the recalibrated ink pressure.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION OF THE INVENTION

Figure 1:
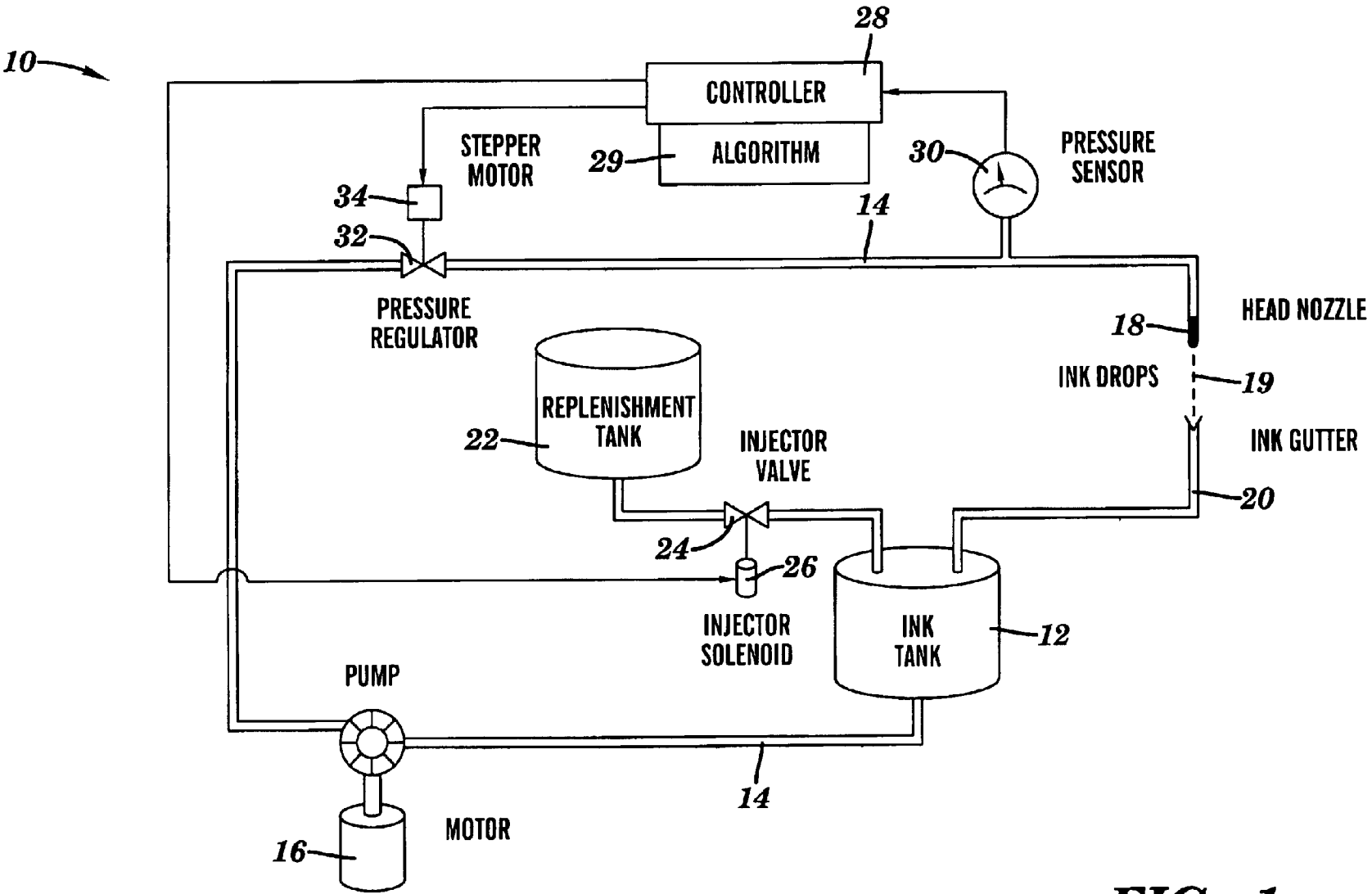
FIG. 1 depicts a diagram of a continuous flow ink jet printer having a replenishment system in accordance with the present invention.

Referring now to the drawings, FIG. 1 depicts a diagram of a continuous flow ink jet printer 10 that utilizes a replenishment system in accordance with the present invention. Printer 10 includes an ink tank 12 for storing a source fluid, in this case, ink. The ink from the ink tank 12 is pumped to a nozzle 18 using a motor 16 via a supply line 14. From the nozzle 18, ink drops 19 are sprayed onto a receiving medium, e.g., paper, in a controlled manner. As noted above, a certain portion of ink drops 19 that are unused during spraying are collected in an ink gutter 20 and recirculated back to the ink tank 12. As also noted, water contained in the ink can be evaporated as the ink flows through the nozzle 18. Accordingly, the recirculated ink may alter the viscosity of the ink in the ink tank 12.

In order to maintain an ideal viscosity, replenishment fluid is injected into the ink tank 12. The replenishment fluid flows from a replenishment tank 22, through a valve 24 and into the ink tank 12. The amount of replenishment fluid added to the ink tank 12 is controlled by periodically activating the valve 24 to allow replenishment fluid to pass to the ink tank 12 for a predetermined length of time. Activation of valve 24 is automatically controlled by controller 28, and can be activated in any manner, e.g., with a solenoid 26.

Controller 28 has two functions, namely (1) to regulate the pressure in the flow line 14, and (2) to control the replenishment rate of replenishment fluid. First, controller 28 periodically recalibrates the pressure in the supply line 14 until an optimum printing is achieved. Algorithms for calculating optimum printing based on sensed pressure are known in the art and the process for regulating pressure may be implemented in any manner. The exemplary embodiment shown in FIG. 1 utilizes a pressure sensor 30 that senses a pressure proximate the nozzle 18, a pressure regulator 32, and a stepper motor 34 that steps up or down the pressure at the pressure regulator 32 based on feedback from controller 28. Pressure is regulated in this manner periodically, e.g., when new ink is added, during printer recalibrations, etc. Thus, the pressure is changed from time to time to ensure optimum print quality is achieved. In a typical embodiment, a printer may be recalibrated every 24 hours to provide the correct pressure. However, the present invention is not limited to a specific recalibration period.

The second function provided by the controller 28 is to control the replenishment rate of the replenishment fluid to the ink tank based on the pressure in the supply line 14. Specifically, once a recalibrated pressure value is determined, which will result in optimum printing, the controller 28 uses the value to calculate a new replenishment rate for the replenishment fluid, based on an algorithm 29. Thus, the replenishment rate of the replenishment fluid is automatically changed whenever a new pressure is applied to the supply line 14.

In the following exemplary embodiment, the replenishment rate is implemented by varying the time interval Ti between injections. Thus, as the value of Ti decreases, the amount of replenishment fluid that is added over a given time period increases. However, it should be understood that any method for controlling the replenishment rate based on the recalibrated pressure value may be utilized. Initially, when new ink is installed in the printer, the pressure regulator 32 is adjusted under program control until optimum printing is detected. The resultant nozzle pressure is sensed by the pressure sensor 30 and is recorded by an algorithm 29 in controller 28 as new ink pressure, Pn. The replenishment rate for the replenishment fluid when new ink is added may be set in any manner, e.g., manually via the controller 28 based on a manufacturer's recommendation, etc. A recalibration of the supply line pressure is thereafter conducted periodically, e.g., every 24 hours, and the recalibrated pressure Pr is also sensed and captured by the algorithm 29. A replenishment rate is then calculated by the algorithm 29 based on a difference between new ink pressure Pn and the current recalibrated pressure Pr.

In one exemplary embodiment for implementing the algorithm 29, two known factors are utilized, the normal evaporation rate En (ml/hr), and the volume Vp of replenishment fluid required to be added to the ink tank 12 to lower the head pressure 1 psi (ml/psi). The volume of fluid Vi (ml), injected per time interval Tn (seconds), is therefore also known. The time interval Tn, to add the nominal evaporation volume is:

$$Tn(\text{seconds})=(Vi/En)*3600 \text{ sec/hr}$$

After a recalibration is accomplished, the recalibrated pressure Pr is read. The difference between the recalibrated pressure, Pr and the new ink pressure Pn is calculated. This difference can be used to find the volume of fluid to be added or withheld until the next recalibration to bring the pressure back to new ink pressure. The volume of fluid delta, Vd, is:

$$Vd(\text{ml})=(Pr-Pn)*Vp$$

The number of injections, Ni to correct the viscosity that must be injected until the next recalibration is:

$$Ni=Vd/Vi$$

Assuming 24 hours between recalibrations, the time period delta Td between injections is:

$$Td(\text{seconds})=(24 \text{ hr}*3600 \text{ seconds/hr})/Ni$$

This is the time delta to alter the time of nominal evaporation rate, Tn. The resultant injection time interval, Ti is:

$$Ti=Tn-Td.$$

Thus, if the recalibrated pressure Pr is higher indicating thicker ink, the injection time interval, Ti should decrease to inject replenishment fluid at a faster rate.

Figure 2:
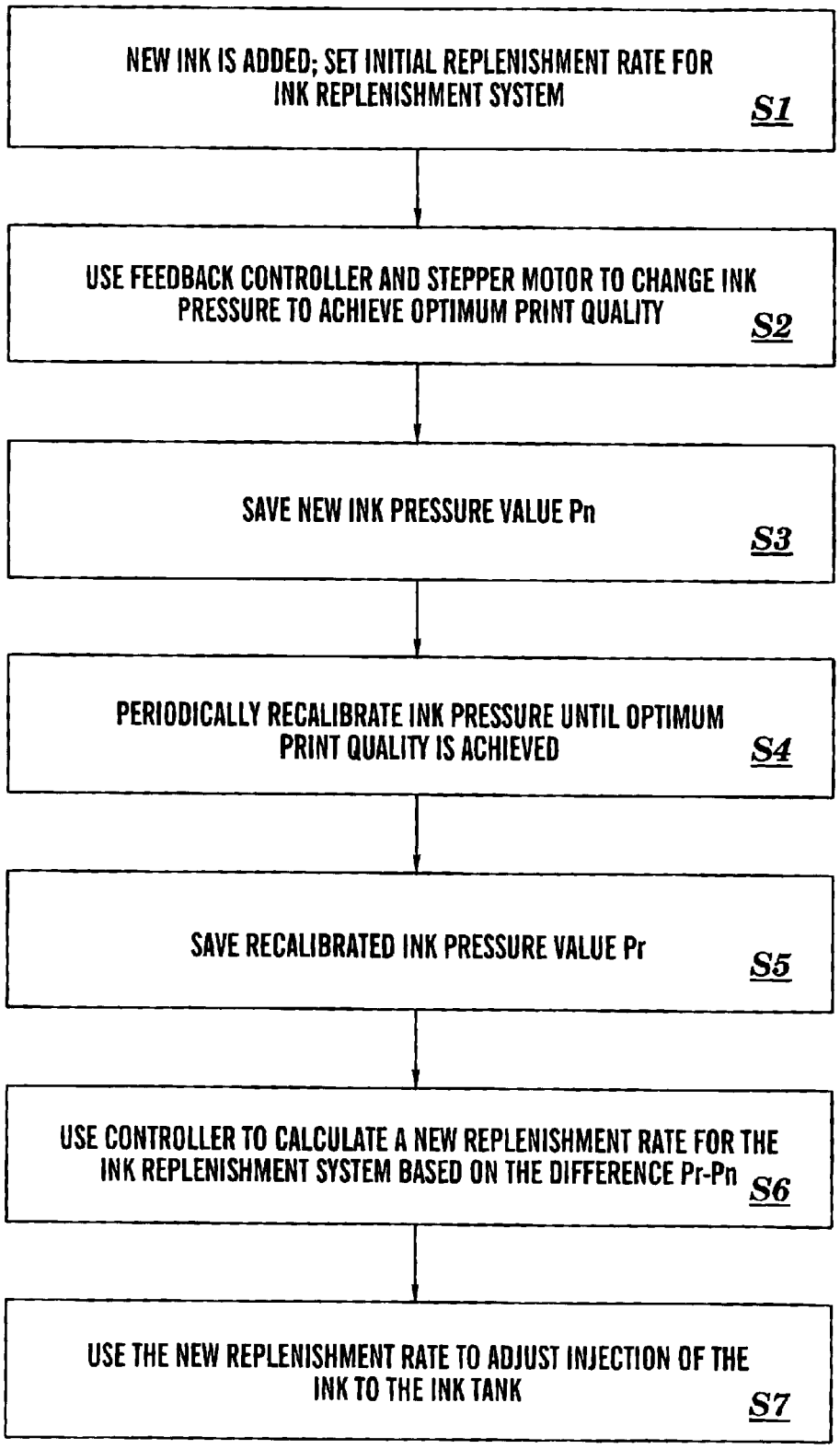
FIG. 2 depicts a flow diagram of a method for implementing a replenishment system in accordance with the present invention.

Referring now to FIG. 2, a flow diagram of an exemplary method of implementing the invention is shown. At step S1, new ink is added to the printer, and an initial replenishment rate is set for the ink replenishment system. At step S2, the ink pressure is changed using a feedback controller and stepper motor to achieve optimum print quality. Once achieved, the new ink pressure value Pn is saved at step S3. At step S4, the ink pressure is periodically recalibrated to achieve optimum print quality, and the recalibrated pressure value Pr is saved at step S5. Next, at step S6, after each recalibration, the controller is used to calculate a new replenishment rate for the ink replenishment system based on a difference Pr−Pn. Finally, at step S7, the new replenishment rate is used to control the ink injection into the ink tank until the next recalibration.

It should be appreciated that while the above description describes systems and methods for controlling the flow of replenishing fluid into an ink tank in a continuous flow ink jet printer, the invention could be applied to any continuous flow system (including ink, paint, fertilizer, liquid, gas, etc.) that utilizes a work piece (such as a nozzle) in which replenishing fluid needs to be added to a source fluid in a source tank.

Moreover, it is understood that the controller 28 described herein can be implemented in hardware, software, or a combination of hardware and software. It may be implemented by any type of computer system or other apparatus adapted for carrying out the methods described herein. A typical combination of hardware and software could be a general-purpose computer system with a computer program that, when loaded and executed, controls the computer system such that it carries out the methods described herein. Alternatively, a specific use computer, containing specialized hardware for carrying out one or more of the functional tasks of the invention could be utilized. The present invention can also be embedded in a computer program product, which comprises all the features enabling the implementation of the methods and functions described herein, and which—when loaded in a computer system—is able to carry out these methods and functions. Computer program, software program, program, program product, or software, in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

What is claimed is:

1. A continuous flow ink jet printer, comprising:

a nozzle that receives ink from a supply line and generates ink drops;

an ink tank for providing ink to the supply line;

an ink gutter for recirculating unused ink drops back to the ink tank;

a replenishment tank that provides replenishment fluid for the ink tank; and a control system that controls the flow of replenishment fluid to the ink tank based on an ink pressure along the supply line.

2. The continuous flow ink jet printer of claim 1, further comprising a valve for activating the flow of replenishment fluid from the replenishment tank to the ink tank.

3. The continuous flow ink jet printer of claim 2, wherein the control system controls the flow of replenishment fluid by adjusting an interval between activations of the valve.

4. The continuous flow ink jet printer of claim 3, wherein the interval is adjusted based on a difference between a current ink pressure and an ink pressure when new ink was installed.

5. The continuous flow ink jet printer of claim 4, wherein the interval is adjusted based on a normal evaporation rate of the ink.

6. The continuous flow ink jet printer of claim 4, wherein the control system regulates pressure with a stepper motor.

7. The continuous flow ink jet printer of claim 1, wherein the control system further regulates a pressure along the supply line.

8. The continuous flow ink jet printer of claim 1, wherein the ink pressure is sensed proximate the nozzle.

9. A replenishment system for supplying replenishment fluid to a supply tank, wherein the supply tank includes a supply line to supply a source fluid to a work piece and a return line to receive unused source fluid, the system comprising:

a replenishment tank that provides replenishment fluid for the supply tank, wherein the replenishment fluid adjusts a viscosity of the source fluid;

a valve that activates a flow of replenishment fluid into the supply tank; and a control system that controls the activation of the valve based on a pressure in the supply line proximate the work piece.

10. The replenishment system of claim 9, wherein the control system controls the flow of replenishment fluid by adjusting an interval between activations of the valve.

11. The replenishment system of claim 10, wherein the interval is recalculated periodically by an algorithm in the control system.

12. The replenishment system of claim 10, wherein the interval is adjusted based on a difference between a current supply line pressure and a supply line pressure when new source fluid was installed.

13. The replenishment system of claim 12, wherein the interval is adjusted based on a nominal evaporation rate of the source fluid.

14. The replenishment system of claim 12, wherein the interval is adjusted based on a predetermined volume Vp required to lower the pressure by 1 psi.

15. The replenishment system of claim 9, wherein the work piece comprises a nozzle and the source fluid comprises ink.

16. A method for supplying replenishment fluid to an ink tank, wherein the ink tank includes a supply line to supply ink to a nozzle and a return line to receive unused ink, the method comprising:

periodically using a control system to recalibrate the ink pressure along the supply line to obtain an optimal print quality; and after the ink pressure has been recalibrated, using the control system to automatically adjust a supply rate of the replenishment fluid to the ink tank, wherein the supply rate of the replenishment fluid is adjusted based on the recalibrated ink pressure.

17. The method of claim 16, wherein the control system includes a pressure sensor located proximate the nozzle and a pressure regulator for recalibrating the ink pressure.

18. The method of claim 16, wherein the supply rate is adjusted based on a difference between the recalibrated ink pressure and an ink pressure measured when new ink was added.

19. The method of claim 16, wherein the supply rate is adjusted based on based on a nominal evaporation rate of the ink.

20. The method of claim 16, wherein the replenishment fluid alters the viscosity of the ink in the ink tank.

* * * * *

UNITED STATES PATENT AND TRADEMARK OFFICE

CERTIFICATE OF CORRECTION

PATENT NO. : 6,935,729 B2
DATED : August 30, 2005
INVENTOR(S) : DeMarco et al.

It is certified that error appears in the above-identified patent and that said Letters Patent is hereby corrected as shown below:

Title page,
Item [75], Inventors, delete "Robe" and insert -- Rohe --.

Signed and Sealed this

Eighth Day of November, 2005

JON W. DUDAS
*Director of the United States Patent and Trademark Office*